US005353035A

United States Patent [19]

Del Castillo Cuervo-Arango et al.

[11] Patent Number: 5,353,035

[45] Date of Patent: Oct. 4, 1994

[54] MICROSTRIP RADIATOR FOR CIRCULAR POLARIZATION FREE OF WELDS AND FLOATING POTENTIALS

[75] Inventors: Paloma Del Castillo Cuervo-Arango; Gaspar Lopez Lopez, both of Madrid; Carlos Martin Pascual, Torrelodones; Carlos Montesano Benito, Madrid; Juan Vassal'lo Sanz, Torrelodones, all of Spain

[73] Assignees: Consejo Superior de Investigaciones Cientificas; Construcciones Aeronauticas, S.A., Madrid, Spain

[21] Appl. No.: 833,832

[22] Filed: Jan. 17, 1992

[30] Foreign Application Priority Data

Apr. 20, 1990 [ES] Spain ..... 9001127

[51] Int. Cl.[5] ..... H01Q 1/38

[52] U.S. Cl. ..... 343/700 MS; 343/729; 343/769; 343/895

[58] Field of Search ..... 343/700 MS, 725, 729, 343/769, 895; H01Q 1/38, 13/08

[56] References Cited

U.S. PATENT DOCUMENTS 4,063,246 12/1977 Greiser ..... 343/700 MS
4,879,563 11/1989 Takeda et al. ..... 343/725

FOREIGN PATENT DOCUMENTS 3527651 2/1987 Fed. Rep. of Germany .
1238355 7/1960 France .
2122341 9/1972 France .

OTHER PUBLICATIONS

Cooper, Airbourne Low-VHF Antennas, Agard, Oberfinanzdirektion Munich, Germany 19-26 Nov. 1973, 8 pages.

"Realization of Wideband Characteristics for a Spiral Antenna Backed by a Conductoring Plane Reflector'-'-H. Nakano et al. (International Symposium Diegest Antennas and Propagation 1989, vol. III, 26-30 Jun. 1989) pp. 1312-1315.

"Radiation Properties of Circularly Polarised Triplate-Type Planar Antenna"-M. Haneishi et al (Conference Proceedings of the 19th European Microwave Conference, 4-7 Sep. 1989, London, England) pp. 161-166.

*Primary Examiner*—Michael C. Wimer
*Attorney, Agent, or Firm*—Darby & Darby

[57] ABSTRACT

New type of planar antenna of microwaves appropriate for operating in linear and circular polarization, free of welds and floating potentials, and therefore free of electrostatic discharges and problems related to passive intermodulation products, whose application is of particular interest in aircraft and space technologies. The antenna consists in the interconnection of a microstrip radiator with a spiral antenna of wires. For certain applications wherein the radiators are arranged in a same plane, the radiating effect of the patch may reduce the size of the spiral.

13 Claims, 5 Drawing Sheets

MICROSTRIP RADIATOR FOR CIRCULAR POLARIZATION FREE OF WELDS AND FLOATING POTENTIALS

BACKGROUND OF THE INVENTION

The use of microstrip radiators in large arrays for use thereof in communication systems has been increasing little by little as new materials and new techniques appear, which aside from resolving problems, have notably cheapened the manufacturing processes.

One of the main problems in space environment of antennas which operate in reception and transmission, is that one weld can generate a spurious signal in the reception strip as a passive intermodulation product (PIMP) of signals coming from the transmission band. The fact that in certain arrays there may be up to 6 welds per radiator makes it necessary to carry out a series of controls of non-existence of PIMP's by means of power tests in a vacuum chamber.

The studies carried out to avoid this matter have been basically directed towards eliminating welds, developing different alternatives to the feeding system, which have been grouped together under the generic name of excitation by electromagnetic coupling (EMC). However, this type of excitation without welds, which is still based on a coupling between the feeding line and the radiating element tends to entail the existence of isolated conductive masses, capable of causing electric discharges upon being at an uncontrolled potential. This problem incapacitates these radiators for their use in aircraft and space technologies.

A simple solution to this problem is to short-circuit the radiating element in points where the electric field is cancelled out, but this requires a well determined linear polarization of the radiated field, and except the including in the radiating system of a polarizing element, outside the radiator, this solution prevents the generating of circular polarization.

BRIEF DESCRIPTION OF THE DRAWINGS

The features and advantages of the present invention will be more fully understood from a reading of the following detailed description, with reference being made to the drawings, in which.

DESCRIPTION OF THE PREFERRED EMBODIMENT

The radiator which is the object of this patent is supplied by electromagnetic coupling from a stripline and it is inlaid in the same structure of the feeding line. Any other type of feeding, other than the cited stripline, is possible. This radiator does not have welds, therefore there are no problems of PIMP's; and it does not contain isolated conductive masses of the conductors belonging to the feeding line, thus, it is free of electrostatic discharges.

Figure 1:
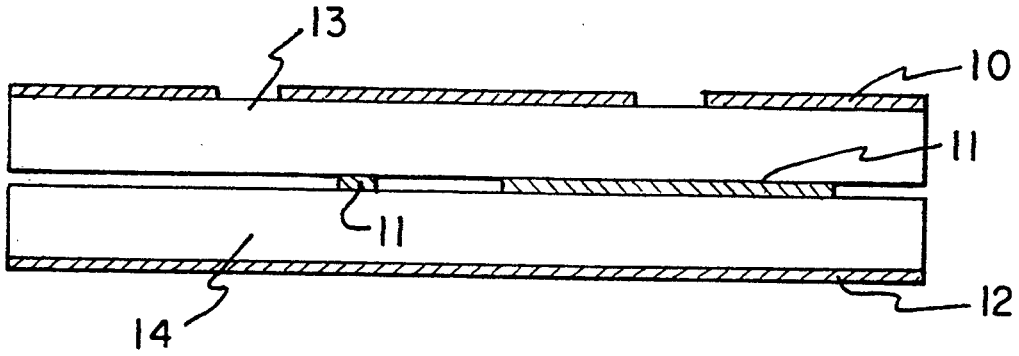
FIG. 1 is a side view an embodiment of the stripline radiator according to the present invention.
Figure 2:
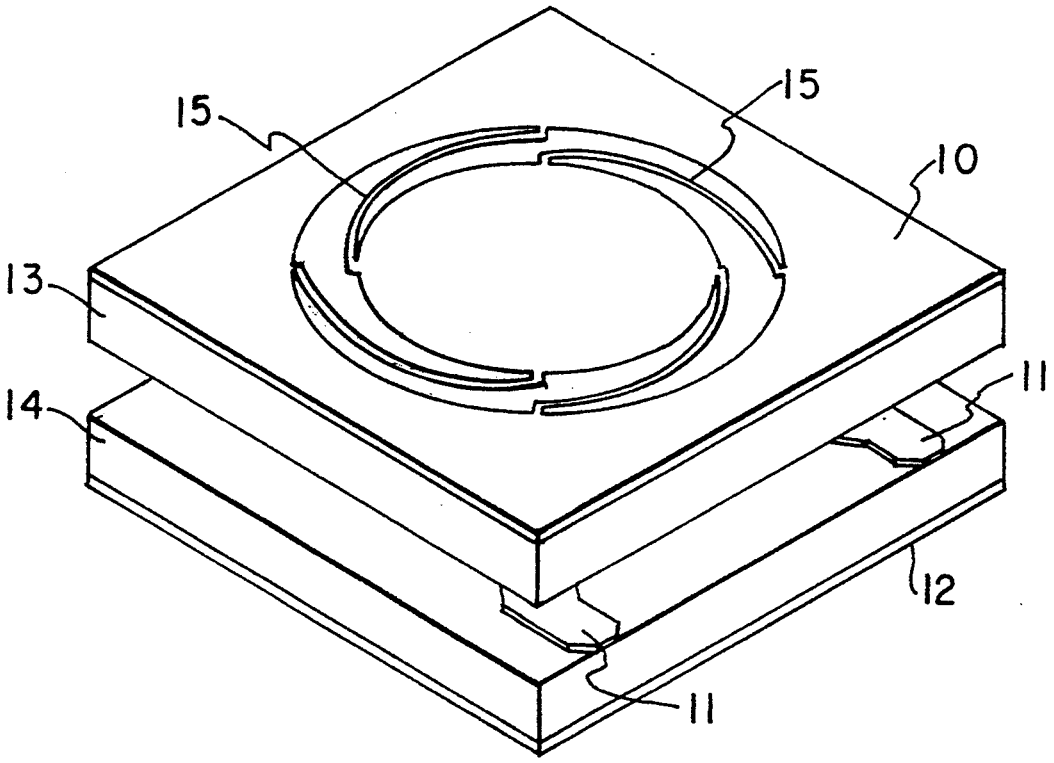
FIG. 2 is a partially exploded perspective view of the stripline radiator of FIG. 1.

As can be seen in FIGS. 1 and 2, the radiator whose application is described, consists of three layers (10), ( 11 ) and (12), separated from each other by two dielectric materials (13) and (14).

The radiating surface (layer (10) in FIGS. 1 and 2) consists of a metallic plane which contains the radiating element, which consists of a circular or square slit, with four wires (15) (existing in the photoetching mask itself), which put in contact both edges of the slit. The metallic part of this plane, outside the radiating element, is one of the ground planes of the feeding stripline.

The layer (11) contains the central strip of the stripline where the feeding circuit is, which can consist of two inputs to generate circular polarization as shown in FIG. 2, or otherwise an input with the adequate disturbance.

The layer (12) consists of a totally metallic plane and is one of the ground planes of the feeding stripline.

Figure 3:
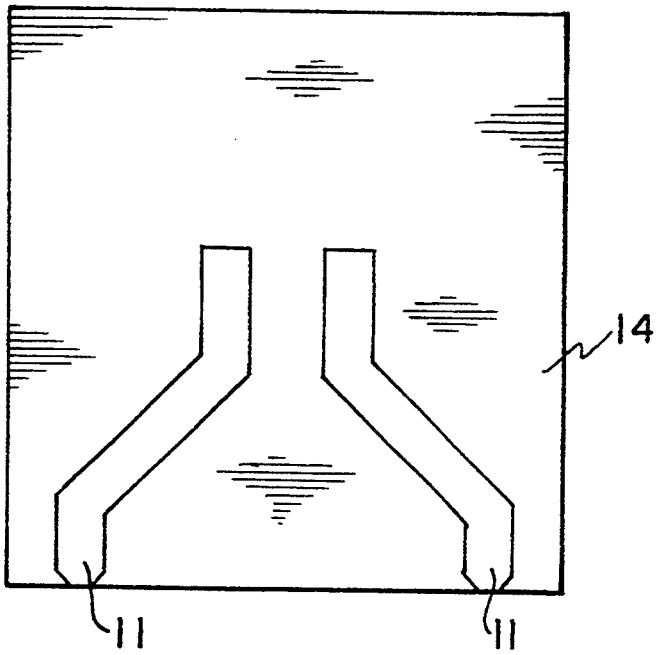
FIG. 3 is a plan view corresponding to FIGS. 1 and 2 showing a dialetric layer and input layer.
Figure 4:
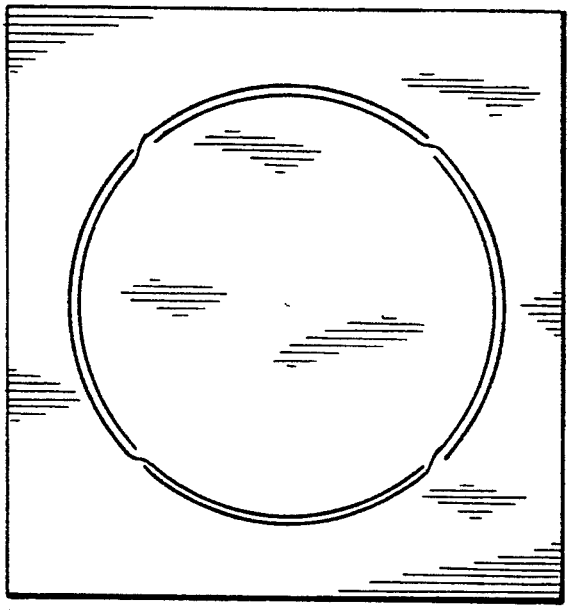
FIG. 4 is a top plan view depicting an alternative embodiment of the arrangement of the spiral strips of the present invention.

FIGS. 3 and 4 show the arrangement of the wires for the configuration of two inputs in the case of the radiator with circular geometry. This arrangement is similar to that of the 4 wire antenna cited in Nakano H. "Research on Spiral and Helical Antennas at Hosei University." IEEE Antennas and Propogation Newsletter, June 1988. Following the philosophy put forth there, the operating of the antenna object of this patent can be reasoned as if the central metallic circle is a patch which feeds a four wire antenna, providing the appropriate phases of excitation mode 1, according to the nomenclature cited in Nakano.

For this reason, and in order to favour radiation of the wire antenna, it would be valid to resort to a design with longer wires, which would make it necessary to increase the size of the circular slit; then there is a compromise, since this increase involves a worsening of the coupling between the stripline and the patch, aside from considerably increasing the size of the radiator.

Nevertheless, and above all when the substrate used is of a low dielectric constant, the overflow of the field of the patch, makes the contribution to the four wire radiation rather smaller than that due to the patch, thus, the performance of the radiator object of this patent, would in such a case be very similar to the classic one of the patch, slightly modifying the gain thereof and the height in the side lobes, when it is used in array.

Figure 5:
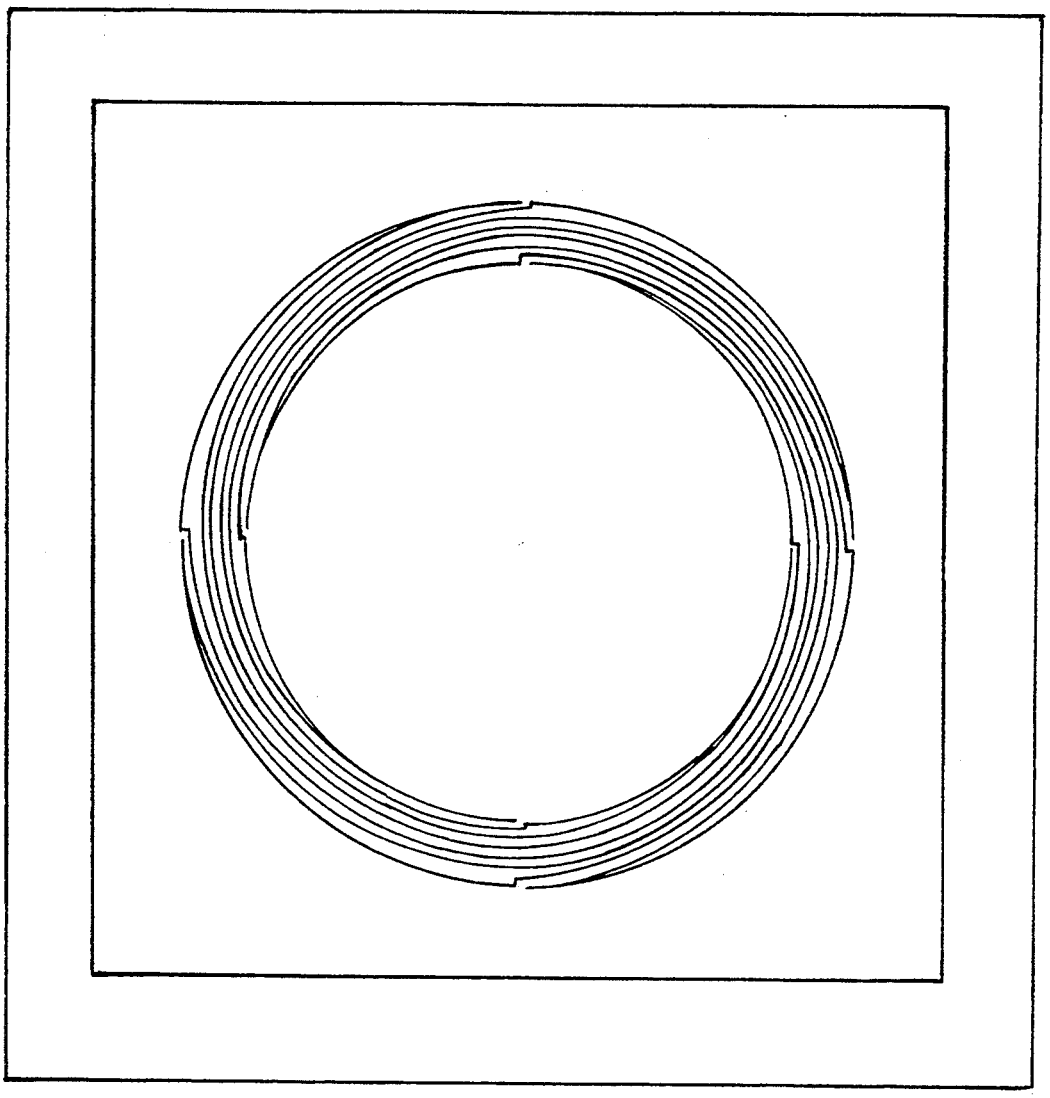
FIG. 5 is a top plan view depicting an alternative embodiment of the arrangement of the spiral strips of the present invention by which left hand circular polarization is improved.
Figure 6:
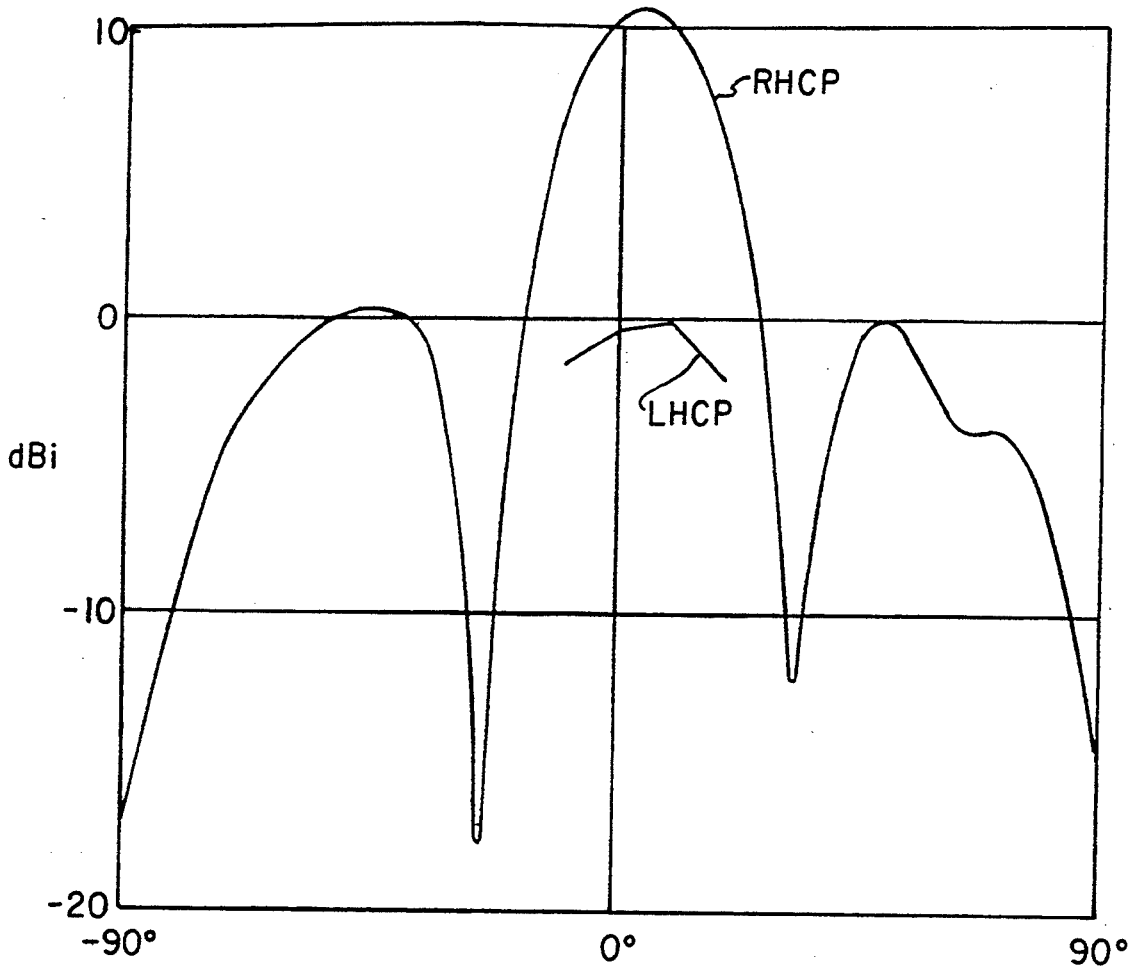
FIGS. 6 and 7 respectively show radiation wavelength patterns indicating right and left hand circular polarizations corresponding to the performance of axial ratios.
Figure 7:
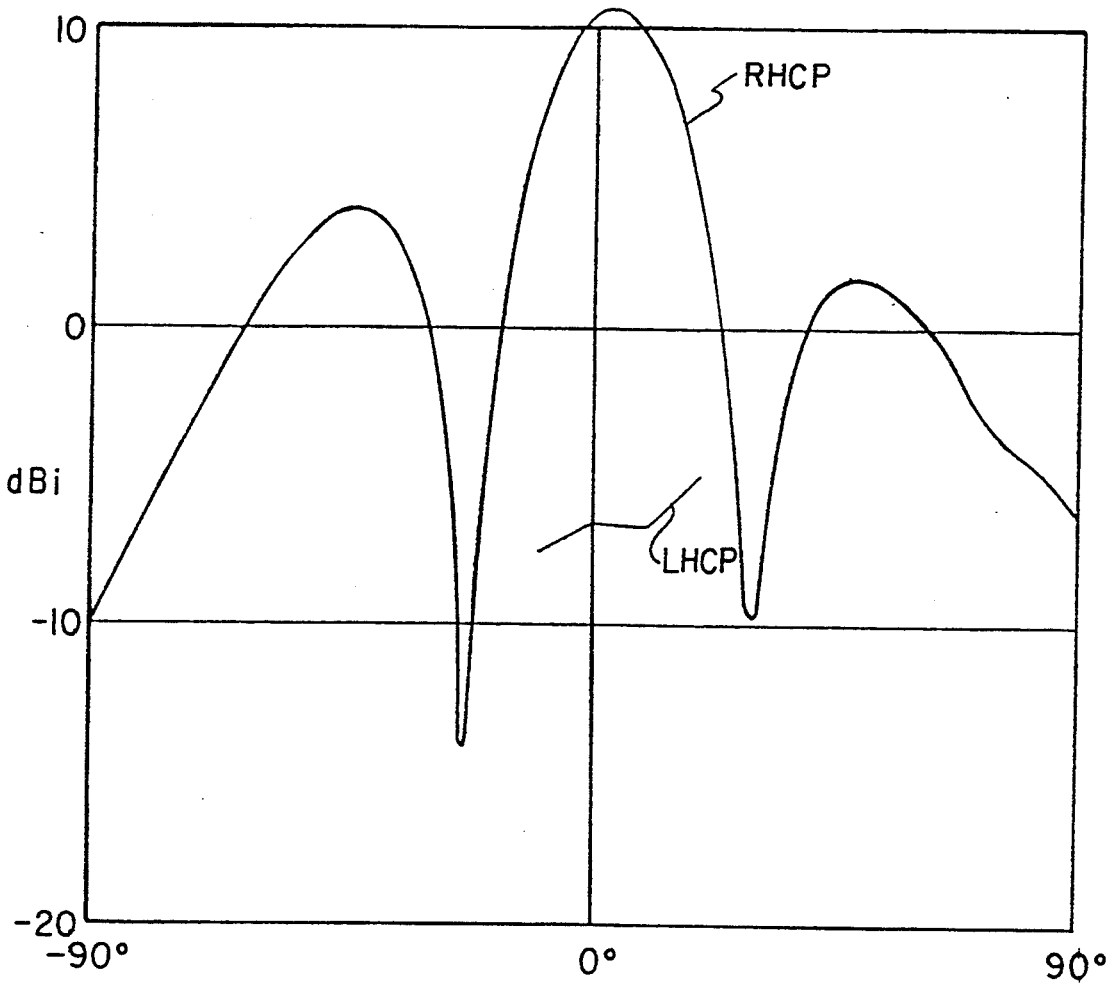

As to the axial ratio, it does not have the same performance when it is used in dual polarization, since an arrangement of wires like that shown in FIG. 5, improves the left hand circular polarization of the patch and worsens that to the right hand, just as it is shown in FIGS. 6 and 7, where the radiation diagrams of two radiators, separated a wavelength in both cases, are represented.

An application that is derived from what is described here is that in which the wire antenna is placed upon a conical or cylindrical surface, the rotation axis being normal to the patch. This arrangement, where the innovation is in the feeding element of the wire antenna being a patch, has its main application in the ground environment, where there are no problems with PIMP's due to the existence of welds.

We claim:

1. An antenna comprising:

a first conductive ground layer;

a radiating patch element separated from said first conductive ground layer by a at least one spiral strip connecting said patch element to said first conductive ground layer;

an input strip terminating at a position vertically below said patch element, said input strip lies in an electrical input layer, a first layer of dielectric material separating said input layer from said patch element, said first layer of dielectric material also separating said input layer from said first conductive ground layer, a second conductive ground layer; and a second layer of dielectric material separating said second conductive ground layer from said input layer.

2. An antenna according to claim 1 wherein said patch element, said first and second conductive ground layers, said electrical input layer and said first and second layers of dielectric material are formed on a conical surface.

3. An antenna according to claim 1 wherein said patch element, said first and second conductive ground layers, said electrical input layer and said first and second layers of dielectric material are formed on a cylindrical surface.

4. An antenna according to claim 1 wherein said patch element is circular.

5. An antenna according to claim 1 further comprising three additional spiral strips connecting said patch element to said first conductive ground layer.

6. An antenna according to claim 1 further including an additional input strip terminating vertically below said patch element.

7. An antenna comprising:

first and second conductive ground layers;

a radiating patch element separated from said first conductive ground layer by a slot;

a wire antenna comprising at least one spiral strip connecting said patch element to said first conductive ground layer;

an electric input layer;

an input strip in said electrical input layer, said input strip terminating below said patch element;

a first layer of dielectric material separating said input layer from said patch element, said first layer of dielectric material also separating said input layer from said first conductive ground layer;

a second conductive ground layer; and a second layer of dielectric material separating said second conductive ground layer from said input layer.

8. An antenna according to claim 7 wherein said patch element, said wire antenna, said first and second conductive ground layers, said electrical input layer and said first and second layers of dielectric material are formed on a conical surface.

9. An antenna according to claim 7 wherein said patch element, said wire antenna, said first and second conductive ground layers, said electrical input layer and said first and second layers of dielectric material are formed on a cylindrical surface.

10. An antenna according to claim 7 wherein said patch element is circular.

11. An antenna according to claim 7 wherein said wire antenna comprises two spiral strips.

12. An antenna according to claim 7 further comprising an additional input strip terminating vertically below said patch element.

13. An antenna according to claim 7, wherein said wire antenna comprises four spiral strips.

* * * * *

UNITED STATES PATENT AND TRADEMARK OFFICE

CERTIFICATE OF CORRECTION

PATENT NO. : 5,353,035

DATED : October 4, 1994

INVENTOR(S) : Paloma Del Castillo CUERVO-ARANGO et al.

It is certified that error appears in the above-indentified patent and that said Letters Patent is hereby corrected as shown below:

On the cover page of the patent, please add the heading "Related U.S. Application Data" and item [63] "Continuation of PCT/ES91/00024, April 19, 1991."

Please insert before the first line of column 1, "This is a continuation of Application Serial No. PCT/ES91/00024, filed April 19, 1991."

Signed and Sealed this

Third Day of January, 1995

*Attest:*

*Attesting Officer*

BRUCE LEHMAN

*Commissioner of Patents and Trademarks*